United States Patent [19]

Simpson

[11] Patent Number: 4,645,376

[45] Date of Patent: Feb. 24, 1987

[54] FIREPROOF BOOM

[75] Inventor: Wayne F. Simpson, Anchorage, Ak.

[73] Assignee: Shell Western E&P Inc., Houston, Tex.

[21] Appl. No.: 806,575

[22] Filed: Dec. 9, 1985

[51] Int. Cl.[4] ..... E02B 15/04

[52] U.S. Cl. ..... 405/63; 405/72

[58] Field of Search ..... 405/63–72; 210/923

[56] References Cited

U.S. PATENT DOCUMENTS

| | | | |
|---|---|---|---|
| 4,062,191 | 12/1977 | Preus | 405/72 |
| 4,065,923 | 1/1978 | Preus | 405/72 X |
| 4,537,528 | 8/1985 | Simpson | 405/63 X |

*Primary Examiner*—Dennis L. Taylor

[57] ABSTRACT

A fireproof boom for containing flammable pollutants on water includes a flotation member, a heat-resistant water-sorbent material surrounding the flotation member and a protective fence surrounding the water-sorbent material. The flotation member is a series of cylindrical metal cans held end-to-end. The heat-resistant water-sorbent material draws water around the heat-sensitive flotation member, forming steam in the presence of flaming pollutant and allowing only the outer layer of heat-resistant material to become slightly singed. The protective fence surrounding the water-sorbent material is heavy steel wire woven in continuous spirals so that when the spirals are integrated with each other a diamond-shaped mesh is formed.

3 Claims, 3 Drawing Figures

FIREPROOF BOOM

BACKGROUND OF THE INVENTION

Booms are mechanical barriers which extend above and below the water surface and which are typically used to (1) enclose, contain, and concentrate spilled oil for recovery; (2) divert the oil to areas in which recovery is more easily conducted; and (3) safeguard commercially valuable or environmentally sensitive areas threatened by accidental spills or chronic pollution.

Although boom size, shape and materials vary widely according to the intended purpose of the boom, commercial booms generally comprise four basic components; (1) a means of flotation, such as a gas-filled compartment or solid float; (2) a freeboard section which extends above the water surface and prevents oil and debris from washing over the top of the boom; (3) a shirt which extends below the surface and keeps contained material from escaping beneath the boom; and (4) a tension member designed to withstand the forces of currents, waves, and winds.

Insitu burning of crude oil on water can be an extremely effective oil spill response, particularly in remote offshore areas and in broken ice where conventional countermeasures are limited. However, insitu burning is a problem insofar as the boom is concerned inasmuch as the boom may be destroyed or severely damaged by the fire. U.S. Pat. No. 4,062,191 discloses a boom wherein a fireproof fabric is utilized to reduce oil spill fire damage to the boom. However, it has been found that the temperature of burning crude oil adjacent to a boom may be at 1600° F. whereas a flameproof fabric such as cloth of woven glass fibers melts at 1100° F. and a foamed polypropylene flotation member melts at 330° F. Manifestly, more is required than simply a flameproof barrier to prevent damage to the boom.

Applicant's copending application Ser. No. 666,717, filed Oct. 31, 1984 and Applicant's U.S. Pat. No. 4,537,528 are incorporated into this disclosure.

SUMMARY OF THE INVENTION

The primary purpose of the present invention is to provide a durable, re-usable fireproof boom for containing a flammable pollutant on a water surface, which boom is capable of resisting the heat of adjacent burning pollutants and preventing significant damage to the boom itself. Preferably, the fireproof boom includes a flotation member, a heat-resistant, water-sorbent material surrounding the flotation member, said material generating steam when exposed to the high temperatures of the burning pollutant and a protective fence surrounding the water-sorbent material. Alternatively, the protective fence of the present invention can be used to protect any boom, whether or not fireproof, which is susceptible to damage by abrasion, rough handling, etc. Preferably, the protective fence is a fence which is woven in continuous spirals which are integrated with each other to form a mesh.

Other purposes, distinctions over the art, advantages and features of the invention will be apparent to one skilled in the art upon review of the following.

DESCRIPTION OF THE PREFERRED EMBODIMENTS

Figure 1:
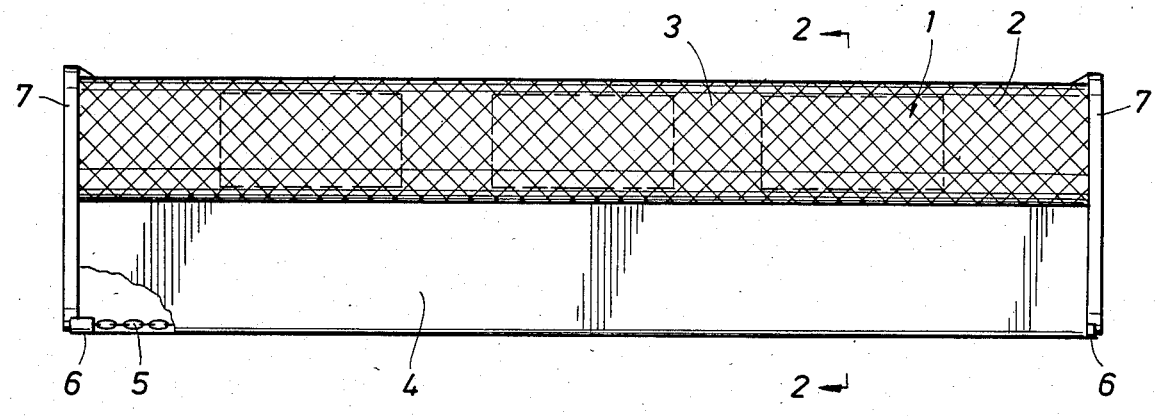
FIG. 1 is a side view of the boom of the present invention.

As above noted, insitu burning of crude oil in water is an extremely effective oil spill response, especially in remote offshore areas and in broken ice where known countermeasures are limited. Insitu burning can be enhanced in accordance with the present invention by containing and thickening the oil with fireproof or fire resistant barriers. The present invention provides a fire containment boom which is particularly suitable for such insitu burning.

The effectiveness of the present fire containment boom depends, in part, on the nature and amount of the oil involved, the wind, sea and ice conditions at the time of containment, and the type of platform (vessel, vehicle or aircraft) being used for deployment. During openwater conditions, the present boom can be deployed, positioned and maintained effectively from vessels. Helicopters can be used to transport the boom components to the spill site if necessary. The fire containment boom of this invention is capable of containing oil in winds, waves and currents.

As ice concentrations increase, the present fire containment boom can still be used by allowing it to drift freely with the ice. If ice sizes and concentrations are such that a protective fence covering the boom cannot keep the boom free of the impact of the ice on performance, the drift mode can be used to prevent or reduce additional spreading within a heavily oiled ice field. The boom might also be positioned in a U-configuration so that wind might concentrate oil within it. As the accumulations build, pools of oil can then be ignited from the surface or from helicopters, etc. Ice concentrations well in excess of 50 percent necessitate flexibility and shallow draft. Both are features of the present boom which can be deployed on and within a heavily packed broken-ice field using helicopters, ice-strengthened tugs, etc. The present boom is used in such concentrations to supplement the existing natural containment of the ice itself.

A critical feature of the present boom is its ability to withstand extremely high temperatures of flaming pollutant, such as oil which may burn at temperatures exceeding 1600° F., without damage to its flotation member which may be constructed of a hollow chamber or chambers which are susceptible to expanding and bursting with the heat. Accordingly, the present invention utilizes heat-resistant material such as woven glass fibers, commonly known as "Thermoglass", and/or other sorbent materials such as "Kaowool" which are wrapped about the flotation member of the boom and which may depend therefrom to from a skirt below the boom. The heat-resistant material must draw water around the boom and maintain itself in a wettened condition. As the heat from the flaming pollutant contacts an outer layer of heat-resistant material, steam is formed inside interior layers of heat-resistant material and prevents further penetration of the heat into the boom to cause damage. Even though an outer layer of heat-resistant material may be singed by the heat of the adjacent burning pollutant, inner layers are damage free. Inspection of these inner layers immediately after a test burning is conducted reveals evidence of the formation of steam therewithin.

Yet another critical feature of the present invention is the use of a protective covering outside the heat resistant material which protects the boom from abrasion, rough usage, etc. Preferably the protective covering is a fence and more preferably a fence of chain link construction. A chain link fence is wire (preferably heavy steel wire) woven in continuous spirals so that when the spirals are integrated with each other a diamond-shaped mesh is formed. The chain link fence not only provides exceptional protection for the boom, but it is quite flexible and does not interfere with normal usage of the boom. In addition, the chain link fence is readily wrapped around the boom and conforms to the boom shape.

Having thus generally described the apparatus and method of the present invention as well as its numerous advantages over the most relevant prior art, the following is a more detailed description thereof given in accordance with specific reference to the drawings.

Figure 2:
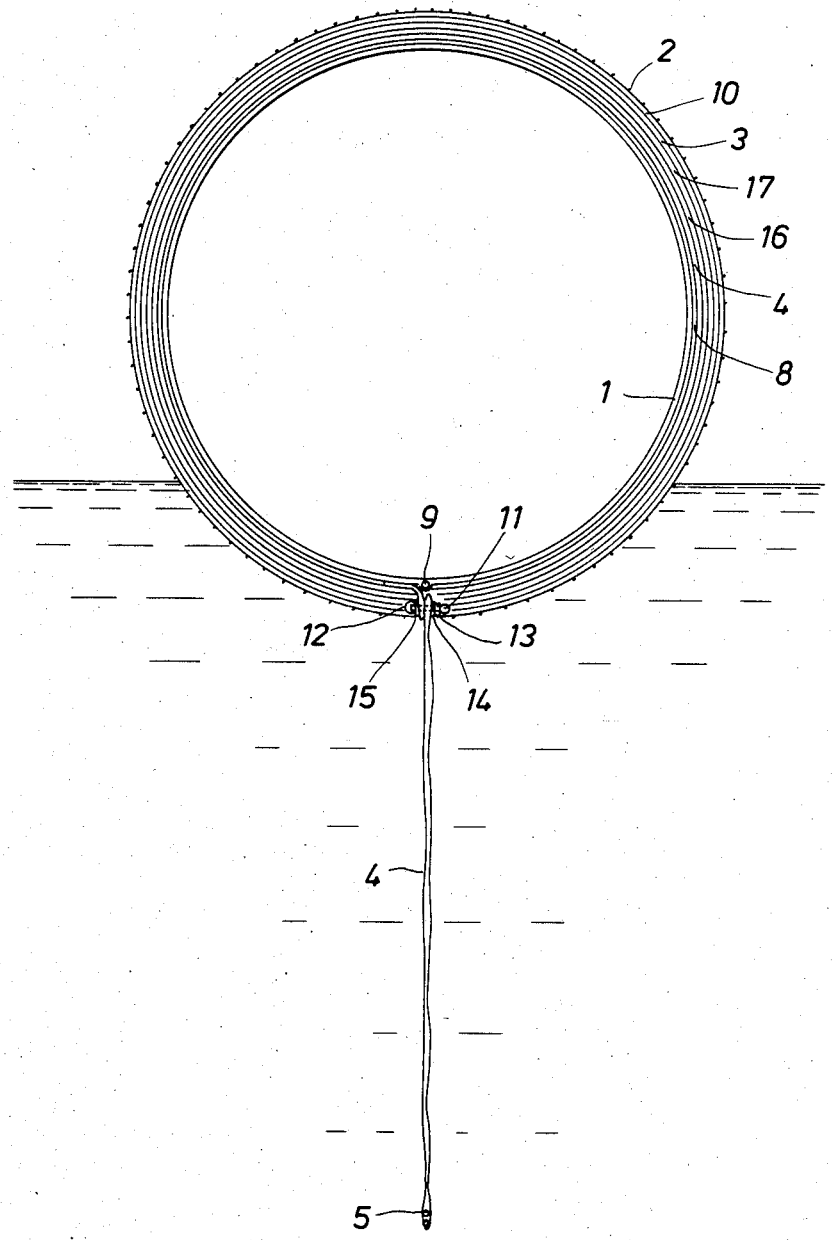
FIG. 2 is a sectional end view of the boom, revealing multiple layers of heat-resistant barrier.

FIGS. 1 and 2 show side and end views, respectively, of the invention. A boom may comprise a number of boom sections. Each of the boom sections comprises at least one flotation element 1, a protective cover 2, and a sorbent 3 between the flotation element and the protective cover. Flotation element 1 is preferably a series of chambers held end-to-end, for example cylindrical metallic cans. Less preferably, the flotation chambers can be of a non-metallic material, e.g., a heat-resistant plastic. Protective cover 2 is preferably woven wire, e.g., a fence. More preferably, cover 2 is a chain link fence as above described. Sorbent 3 is a heat-resistant, flame-resistant, nonflammable, or fireproof material. Preferably, sorbent 3 is woven glass fibers, e.g., a cloth sometimes referred to as "Thermoglass" although other sorbents such as "Kaowool", an alumina silicate fiber, may be used alternatively or with the "Thermoglass" or other suitable materials. While the sorbent 3 may be mounted only on the side of the boom facing the pollutant spill, it is preferred for ease of construction and other convenience that the sorbent 3 completely encircle the flotation 1. Depending below the flotation 1 and protective cover 2 is a skirt 4 which is preferably of sufficient depth to prevent pollutant from sweeping under the boom. The upper part of the boom, on the other hand, is of sufficient dimensions to prevent waves from carrying pollutant over the boom. The boom is preferably bottom tensioned, e.g. by chain 5 or other tensioning means to maintain the skirt vertically oriented. At both ends of chain 5 are double clevis links 6 or other fastening means which attach to connector bars 7 which in turn attach to the upper ends of the boom.

FIG. 2 is a cross-sectional end view of the boom and shows the various layers of material forming the boom. Immediately adjacent flotation 1, which is preferably a steel float, is a band 8 of relatively small width, preferably stainless steel, which secures a cable 9, to the flotation 1, the cable extending longitudinally of the boom, connecting one flotation member to the next, etc. Also, immediately adjacent flotation 1 and covering band 8, is skirt 4, preferably polyvinyl chloride, which is secured with eye bolt 11, eye nut 12, nut 13, and washers 14 and 15. A double layer of skirt 4 extends down to and encircles chain 5. Encircling flotation 1 outside skirt 4 are multiple layers of sorbent material 16, 17 and 3, preferably respectively 36 ounce "Thermoglass", 70 ounce "Thermoglass" and 70 ounce "Thermoglass". A net fabric 10 (not shown in FIG. 1), preferably a vinyl coated polyester screen fiber, encircles the outside sorbent material to provide additional abrasion protection. A final covering is protective fence 2 which provides structural integrity and abrasion resistance.

Figure 3:
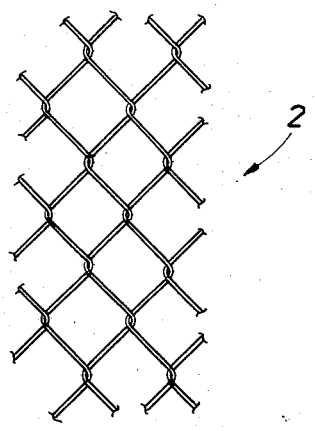
FIG. 3 provides a detailed view of the mesh links of a protective cover for the boom.

FIG. 3 shows details of a preferred protective cover 2, which is preferably a fence such as chain link fence or the equivalent. Chain link fence is woven in continuous spirals which are integrated with each other to from a mesh, e.g a diamond-shaped mesh. The fence is highly flexible and does not interfere with the movement and use of the boom.

The foregoing description of the invention is merely intended to be explanatory thereof. Various changes in the details of the described boom may be made within the scope of the appended claims without departing from the spirit of the invention.

I claim as my invention:

1. A fireproof boom for containing a flammable pollutant on a water surface comprising, a hollow flotation member susceptible to expanding and bursting with the application of heat, a heat-resistant, water-sorbent material surrounding the flotation member and extending into the water and functionable to perform an osmotic wicking action to draw water up into the heat-resistant material and around the flotation member, thereby positioning the water to form protective steam about the flotation member upon exposure of the boom to fire, and a protective fence covering the heat-resistant, water-sorbent material, said protective fence being wire woven in continuous spirals so that when the spirals are integrated with each other a mesh is formed.

2. The boom of claim 1 wherein the mesh is diamond-shaped.

3. The boom of claim 1 wherein the fence is a chain link fence.

* * * * *